United States Patent [19]

Hood

[11] 4,266,495

[45] May 12, 1981

[54] APPARATUS FOR SUPPORTING A SAIL

[76] Inventor: Ralph S. Hood, 2543 Lucille Dr., Fort Lauderdale, Fla. 33905

[21] Appl. No.: 75,511

[22] Filed: Sep. 13, 1979

[51] Int. Cl.[3] ..... B63H 9/04

[52] U.S. Cl. ..... 114/106; 114/107; 114/108

[58] Field of Search ..... 114/102, 104, 105, 106, 114/107, 108, 111, 112, 113, 114, 115

[56] References Cited

U.S. PATENT DOCUMENTS

| | | | |
|---|---|---|---|
| 1,304,788 | 5/1919 | Macrae | 114/107 |
| 2,561,253 | 7/1951 | Wells-Coates | 114/102 |
| 3,040,690 | 6/1962 | Harless | 114/108 |
| 3,938,460 | 2/1976 | Wales et al. | 114/106 |
| 3,980,036 | 9/1976 | Crall | 114/106 |
| 4,077,347 | 3/1978 | Arce | 114/108 |

FOREIGN PATENT DOCUMENTS

| | | | |
|---|---|---|---|
| 8560 | 3/1980 | European Pat. Off. | 114/105 |
| 2635717 | 2/1978 | Fed. Rep. of Germany | 114/106 |

*Primary Examiner*—Edward R. Kazenske

[57] ABSTRACT

Apparatus for supporting a sail is provided whereby the sail is hoisted by a halyard, and latched in the fully hoisted position. The halyard is then disconnected from the sail leaving the sail free to rotate, for reefing or furling purposes independently of the halyard. The sail is lowered by unlatching same from the fully hoisted position, the unlatching being accomplished by raising a rotatable tubular member to which the luff of the sail is slidably attached, so as to release the latch.

8 Claims, 8 Drawing Figures

FIG. 2
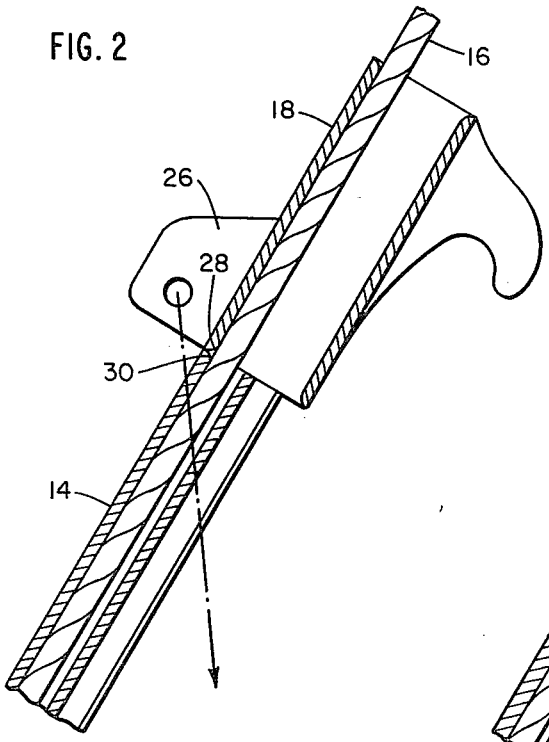
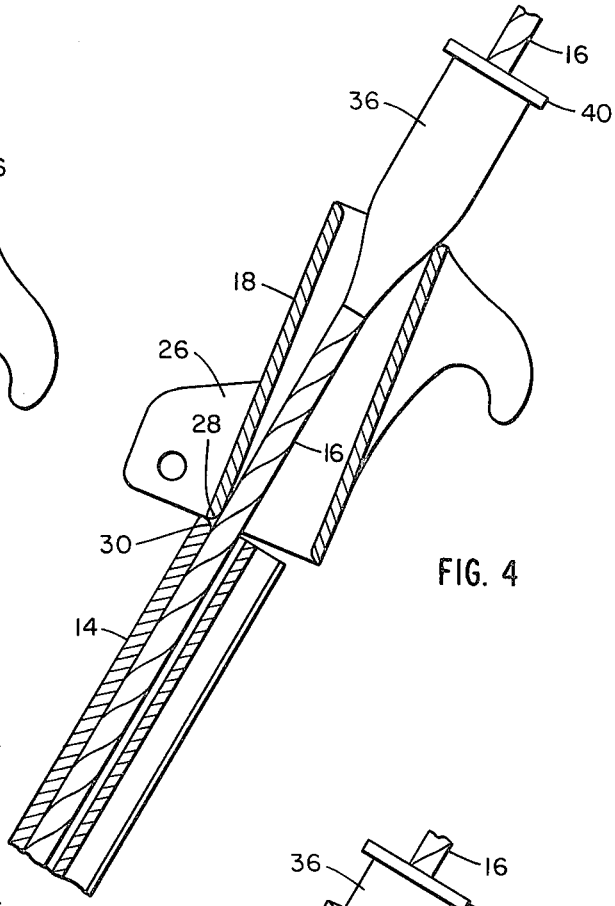
FIG. 4
FIG. 3
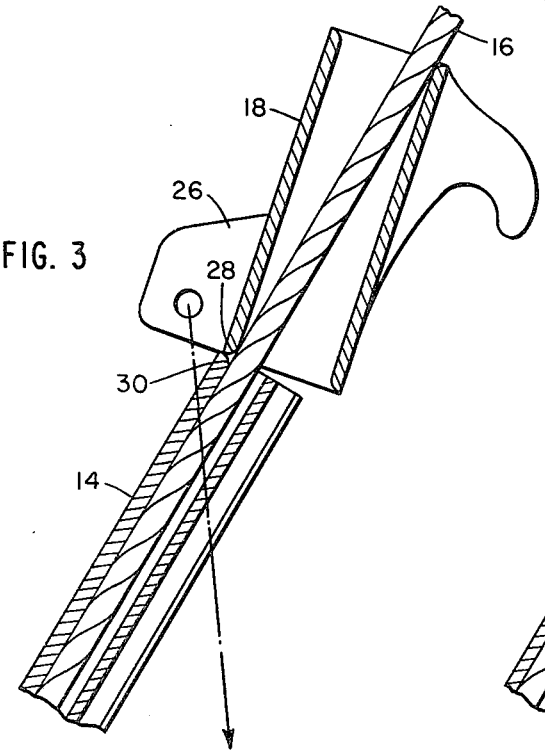
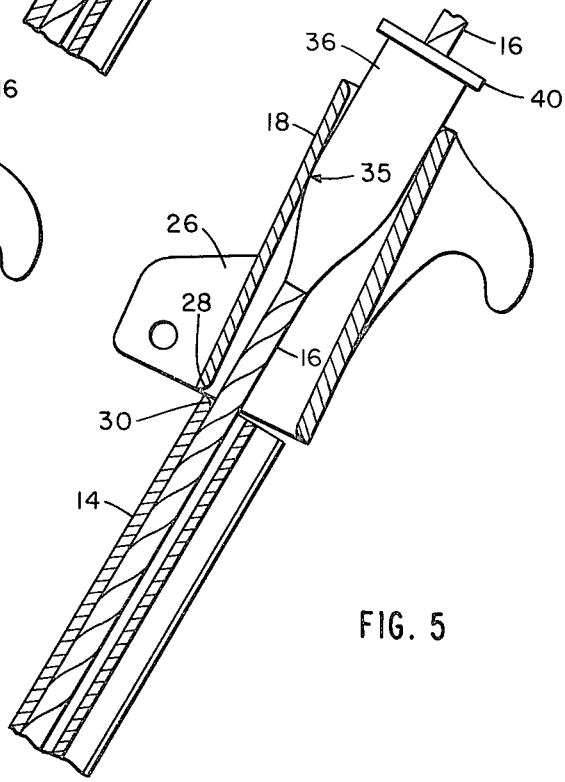
FIG. 5

FIG. 7
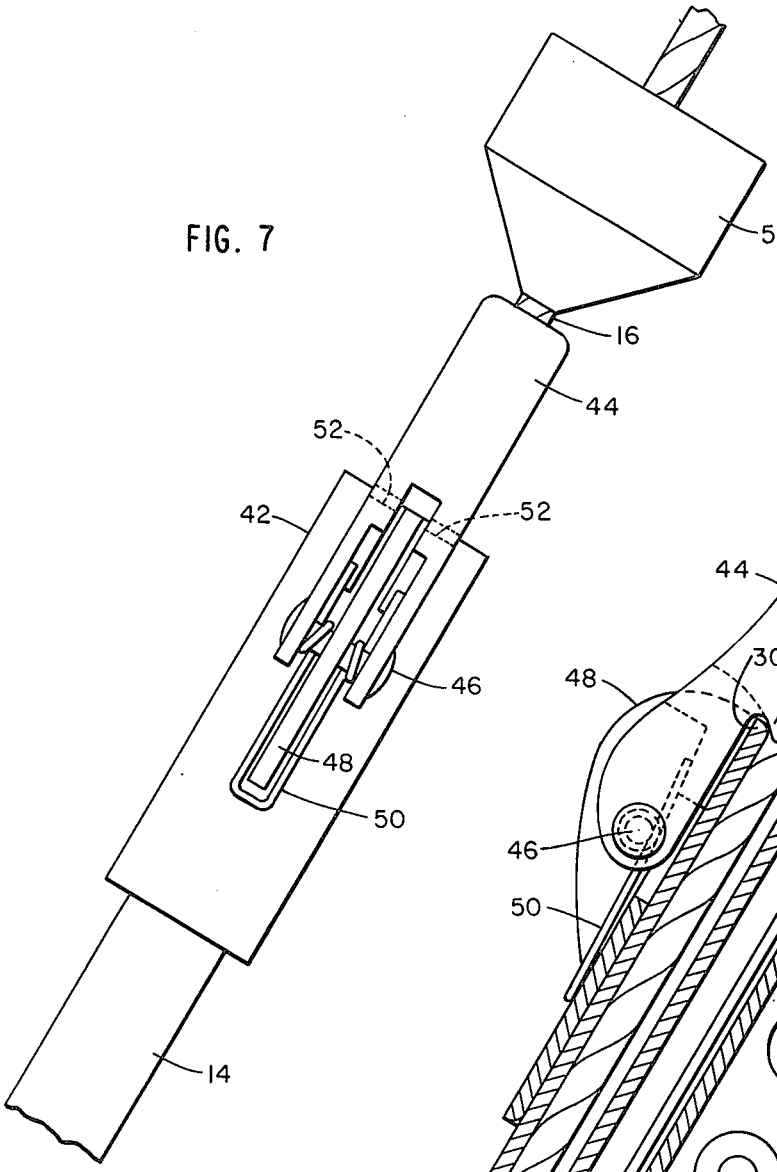
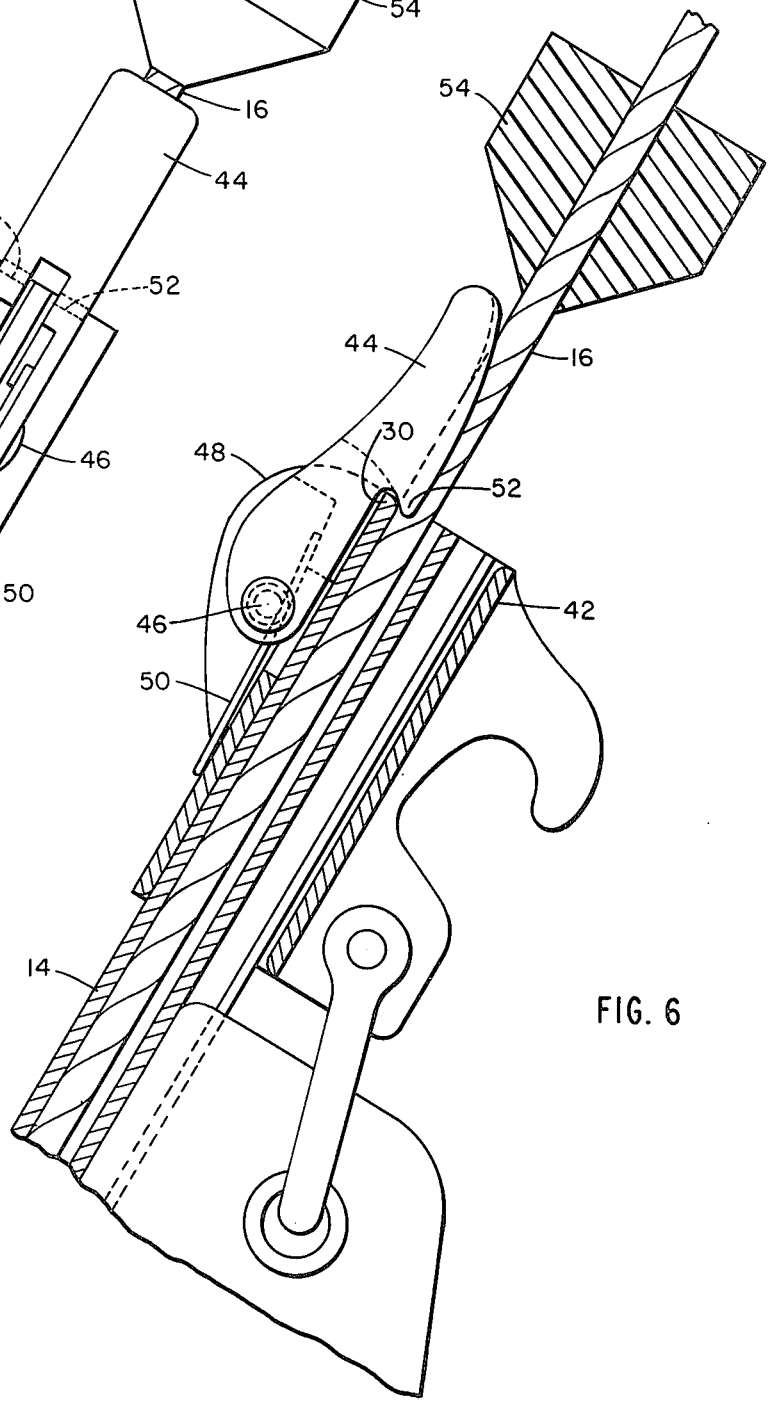
FIG. 6

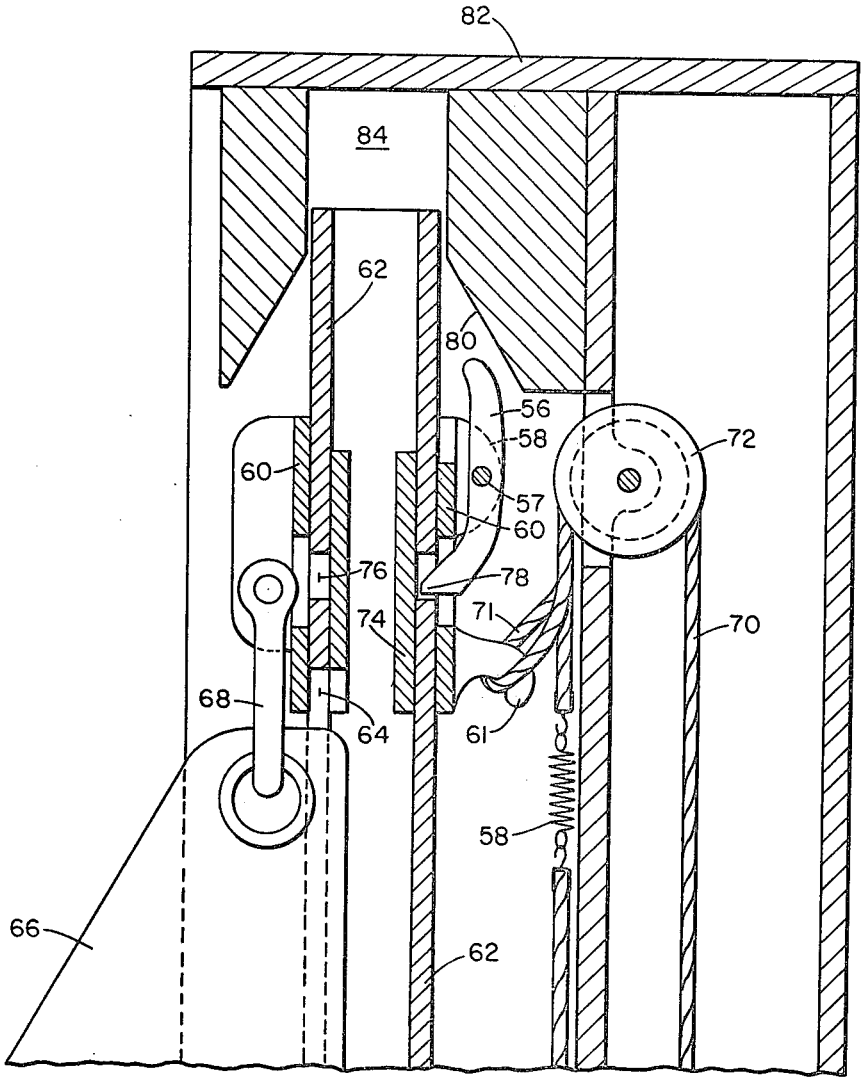
FIG. 8
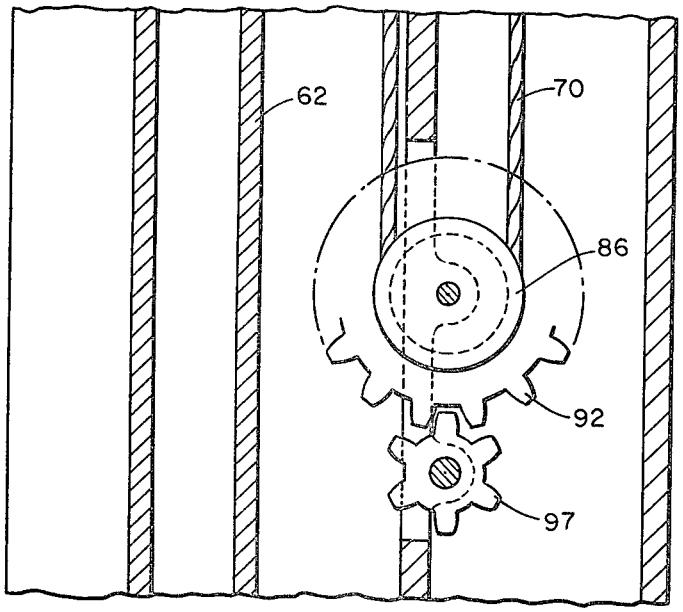

APPARATUS FOR SUPPORTING A SAIL

FIELD OF THE INVENTION

The present invention relates to sailboat rigging and more specifically to supporting the peak of a fore-and-aft rigged sail, the luff of which is adapted for roller reefing and/or furling.

BACKGROUND OF THE INVENTION

Recent developments in equipment for roller reefing and furling have included supporting the luff of the sail on a rotatable tubular member in such a way that the tubular member, not the mast, bears the tension of the downhaul and the weight of the sail.

One of the problems, however, with such rotatable tubular members relates to interference with the halyard. Normally, after hoisting the sail, the portion of the halyard used for hoisting the sail is cleated, coiled and hung onto a cleat at the base of the mast. When a rotating tubular member, however, is used for reefing or furling the sail, the halyard must be fitted with a swivel at the peak of the sail or else it must be adapted to rotate with the tubular member. The swivel alternative is undesireable because, in a salt air environment, swivels are difficult to maintain and tend to become jammed. On the other hand, rotating the entire halyard also presents problems because the coil of the part of the halyard used for hoisting the sail cannot be swung around without a serious risk of its becoming uncoiled and tangled. In U.S. Pat. No. 3,980,036, a solution for the halyard problem is suggested. It provides for disconnecting and stowing the part of the halyard used for hoisting. Once the sail has been hoisted, the halyard is made fast to the base of the rotatable tubular member, and the part of the halyard which was used for hoisting the sail, is removed and stowed. This frees the tubular member for rotation without interference from the halyard. (A similar procedure is also described in co-pending application Ser. No. 898,290). Employing a two-part halyard, however, and having to separate it or reconnect its parts is a nuisance, and exposes the user to the risk of losing the tension part of the halyard up the mast. Accordingly, an object of the present invention is to employ a single piece halyard which does not interfere with the rotation of a rotatable tubular furling member and with which there also is no risk of losing the halyard up the mast. A further object of one embodiment of the invention is to provide an endless one-piece halyard which presents no interference with the operation of a rotatable tubular furling or reefing member and which does not need to be cleated.

Rotatable tubular furling arrangements of the type disclosed in U.S. Pat. No. 3,980,036 have a further disadvantage in that they require the use of a sheave at the top of the rotatable tubular member over which the halyard passes. Such sheaves can cause problems particularly if the halyard slips out of the pulley groove. In addition, with such an arrangement the sheave subjects the rotatable tubular member to twice the force of the weight of the sail and the downhaul. Accordingly, another object of the invention is to provide a rotatable tubular member for furling a sail which does not require the use of a halyard sheave at the top of the rotatable tubular member and in which the thrust on the rotatable tubular member is only once the weight of the sail plus the force of the downhaul.

In U.S. Pat. No. 3,938,460 means are described for supporting the sail on a rotatable tubular member without the use of a halyard sheave and thereby achieves the latter-mentioned object. The arrangement employs a sleeve slidably mounted on the rotatable member and a ratchet and spring-loaded pawl to latch the sleeve at the top of the rotatable member while the sail is in use. When it is desired to lower the sail the sleeve is released from the top of the rotatable member by a cam-release mechanism similar to that used on ordinary extension ladders. The halyard is used to lift the sleeve. This brings into play a cam element which prevents the sleeve from latching as it is lowered. This frees the sleeve from the ratchet and permits the sail to be lowered. Once the sleeve has been lowered below the ratchet, the cam element drops back by gravity to its original position in which the sail can again be hoisted and latched to the top of the rotatable member if desired. Thus, by operation of the halyard, the sleeve which supports the peak of the sail can be latched to the top of the rotatable tubular member so that the latter bears the weight of the sail. Alternatively, the sleeve can be unlatched from the top of the rotatable furling member, so that the halyard bears the weight of the sail.

The arrangement of U.S. Pat. No. 3,938,460, however, has other problems. For one thing, it requires the halyard to remain secured to the sleeve at the peak of the sail, and this creates serious problems due to the fact that, when the rotatable tubular member is rotated, the halyard becomes wound up on the stay and is difficult to unsnarl. This problem is not cured by the use of a swivel because the halyard and the stay are so nearly parallel that only slight resistance in the swivel causes the undesired wrapping. Conversely, if the tension on the halyard is relieved, the undesired wrapping action takes place without resistance. Further, once the halyard is wrapped around the stay in this manner, the sail cannot be raised or lowered, and can be either embarrassing or dangerous.

Another problem associated with release mechanisms of the type shown in U.S. Pat. No. 3,938,460 is that they do not operate well in the sailboat context. Thus, when a fore-and-aft rigged sailboat "comes about", the sails go through a phase of flapping while the boat passes through the head-to-wind position. The intensity of the flapping, of course, increases with the force of the wind. This flapping action in fact often causes the peak of the sail to oscillate back and forth through an arc of as much as 120° creating substantial centrifugal force which in turn acts on the latching mechanism tending to release the pawl from the ratchet teeth. This tendency to release, of course, is increased as the force of the wind increases, and accordingly, the danger of unintentional release increases at the same time as the undesireability of surprise increases. The centrifugal force also affects the operation of the cam element used to release the sleeve for lowering the sail, and can cause the cam to fail to operate and thereby prevent the lowering of the sail at the critical moment in a gale when the need to lower the sail may be the greatest. An object of the invention is, therefore, to provide a latching mechanism which can be operated with certainty from the deck without interference from centrifugal forces due to flapping of the sail during the head-to-wind phase.

Accordingly, among the objects of the present invention is the provision of means for supporting the peak of a sail on a rotatable furling or reefing member independently of the halyard and in such a way as to relieve the mast of the weight of the sail, and the tension of the downhaul. In addition it is an object to relieve the rotatable tubular members of the tension of the halyard, and simultaneously to provide means at the deck level independent of the halyard for releasing the peak of the sail from the rotatable member so as to lower the sail without operation of the halyard. A further object is to provide means for securing the peak of the sail to a weight-supporting rotatable member, the operation of which securing means is relatively immune from the centrifugal forces which flapping at the peak of the sail creates.

BRIEF DESCRIPTION OF THE INVENTION

In a preferred embodiment of the invention a tubular extrusion is mounted to rotate on the headstay of a fore-and-aft rigged boat. The tubular extrusion is provided with a C-shaped groove adapted to receive and hold the luff bead of a headsail such as a genoa jib, and means are also provided to rotate the tube to furl the sail. The sail is hoisted by means of a halyard which is releasably hooked onto a sleeve which is slidably mounted on the rotatable tubular member, the peak of the sail being secured to the sleeve. The sail is hoisted until the sleeve is clear of the top of the rotatable tubular member, at which point the sail is lowered until the sleeve comes into abuttment with the top of the tubular rotatable member so as to support the sail. Thereafter the halyard is further lowered so as to unhook it and completely remove it from the sleeve. The sail may then be lowered by releasing the sleeve from the top of the rotatable tubular member. This is done from deck level by lifting the rotatable tubular member so as to slide it up the headstay and bring the sleeve into engagement with a plug on the headstay which aligns the sleeve with the rotatable tubular member thereby permitting the sleeve to slide down the tubular member.

A basic feature of the invention is that once the sail is hoisted the halyard is completely removed from the peak of the sail. Thus, the halyard need only be strong enough to hoist the sail, and tension on the downhaul can be applied after the sail is hoisted. In addition, the halyard can be an endless loop whereby risk of losing the halyard up the mast is eliminated. A further feature of the invention is that the release mechanism employed for disengaging the peak of the sail from the top of the rotatable tubular member in order to lower the sail, is actuated solely by lifting the tubular rotatable member itself without operation of the halyard.

Still another feature of one embodiment of the invention is that the center of mass of the combined elements at the peak of the sail (i.e. the sleeve, the shackle connecting the peak of the sail to the sleeve, the grommet, and the reinforcing plate at the peak of the sail) is aft of the pivot axis of the tubular rotatable member. Thus, the centrifugal forces due to rotation of the elements at the peak of the sail (due to flapping), draw the sleeve even more securely into the locked position when flapping occurs.

In one embodiment, a shackle is employed to secure the peak of the sail to the sleeve in such a way that the weight of the sail tips the sleeve forward and ensures that the lower forward and upper rear lips of the sleeve only contact the headstay. In this way the lower forward lip of the sleeve is tightly wedged against the upper forward edge of the tubular rotatable member, and the sleeve is held in the tipped position by the weight of the sail. By this arrangement, increasing the downward or rearward forces on the sail only make the supporting connections more tightly engaged.

A tapered plug mounted on the headstay is used to release the sleeve from the top of the tubular rotatable member when one desires to lower the sail. The plug and sleeve are dimensioned so that the sleeve fits over the plug so that the plug aligns the sleeve coaxially with the headstay, in which position the sleeve becomes free to slide down the tubular rotatable member. Lifting the sleeve onto the tapered plug is done by lifting the entire tubular rotatable member from the deck level so as to force the sleeve up around the tapered plug. When the sleeve has been forced far enough up onto the tapered plug to tip the sleeve into axial alignment with the headstay, the lower forward lip of the sleeve is freed from the forward upper edge of the tubular rotatable member, and the sleeve and the sail along with it can drop down.

It is a feature of the invention that no swivels are used and the tubular rotatable member bears only the weight of the sail and the tension of the downhaul. The downhaul can therefore be made as tight as desired without placing any strain on either halyard and or mast, and the force of the downhaul on the tubular member is not doubled. Thus, the mast and the rotatable tubular member may be lighter, and the halyard need only be strong enough to hoist the sail.

BRIEF DESCRIPTION OF THE DRAWINGS

Several illustrative embodiments of the present invention are shown in the acompanying drawings in which:

FIG. 2 is an enlarged view in cross-section of the tilting latch arrangement of FIG. 1 showing the relationship between the pivot of the latch and the thrust axis of the weight of the sail;

FIG. 3 is a view in cross-section of the tilting latch arrangement in the latched position;

FIG. 4 is a view of the arrangement of FIG. 3 showing the tapered plug in an intermediate position;

FIG. 5 is a view of the arrangement of FIG. 3 showing the tapered plug at the point at which it has aligned the sleeve sufficiently coaxially to release the sleeve from latching engagement with the top of the rotatable member;

FIG. 6 is a view in side elevation partially in cross-section of a spring-loaded pawl locking arrangement for a headstay;

FIG. 7 is a view in front elevation of the arrangement of FIG. 6; and

FIG. 8 is a cross-sectional view in side elevation of an embodiment employing the invention in the context of a rotatable furling element associated with a mast as distinguished from a stay.

DETAILED DESCRIPTION OF THE INVENTION

Figure 1:
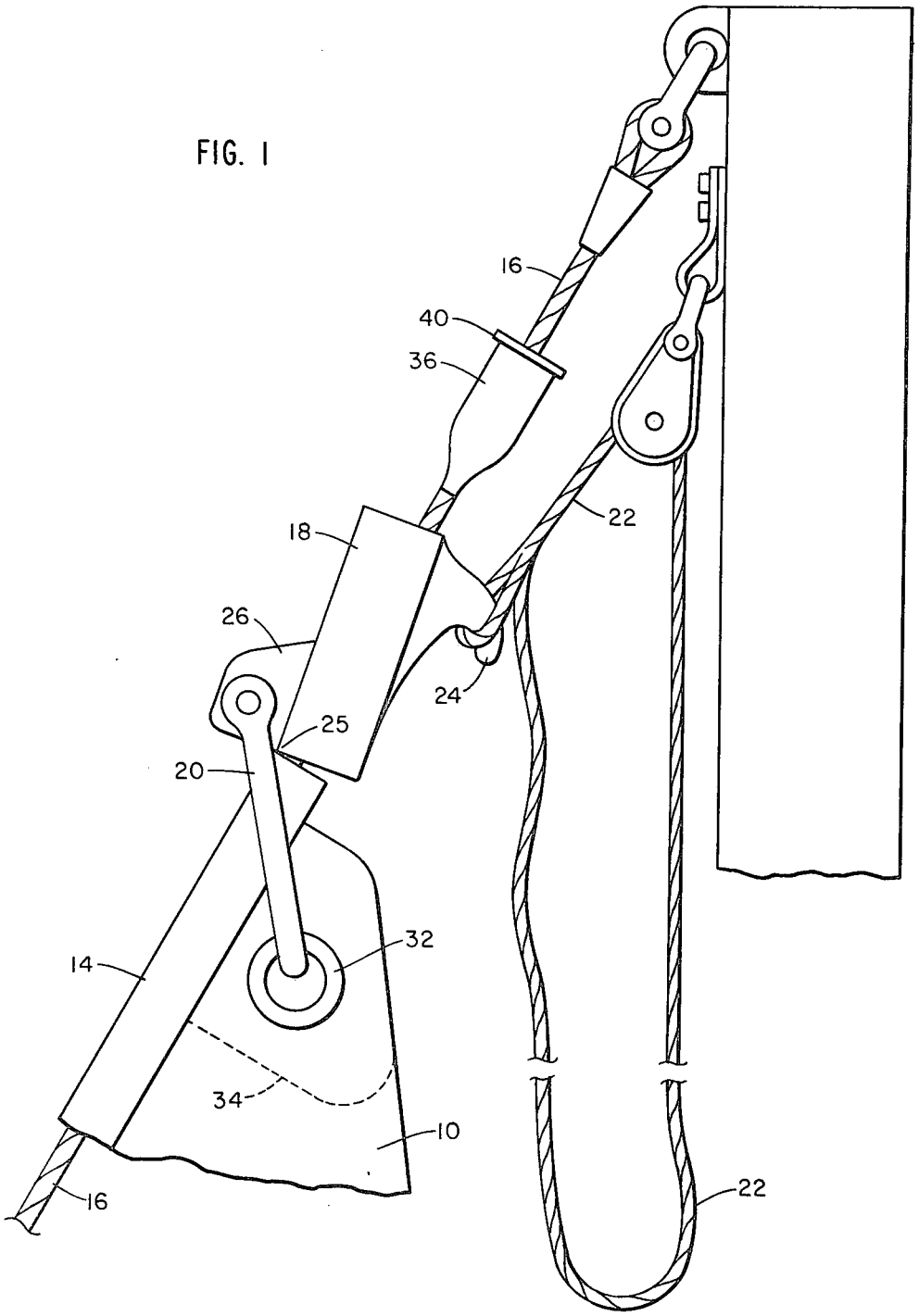
FIG. 1 is a view in side elevation of a tilting latch arrangement conforming to the invention in the context of supporting the peak of a headsail.

The embodiment of the present invention, shown in FIGS. 1 to 5, is adapted to support a foresail 10, the luffbead of which is anchored in a C-shaped groove in a rotatable tubular member 14, rotatably and slidably mounted on a forestay 16. The sail 10 is furled by rotating tubular member 14 by means (not shown) at its lower end. The peak of the sail is supported in the hoisted position by a sleeve 18 to which the peak of the sail is connected by shackle 20. A halyard 22 is hooked onto sleeve 18 at 24 and sleeve 18 is adapted to slide up tubular member 14 when halyard 22 is employed to hoist the sail. Sleeve 18 rests on top of member 14 when the sail is in the fully hoisted position. Shackle 20 is connected to a forwardly extending plate 26 on sleeve 18 in a position low enough and far enough forward in relation to lower forward rim 28 of sleeve 18 to cause sleeve 18 to tilt forward in response to the weight of the sail, pivoting around lower forward rim 28. In this position (shown enlarged in FIG. 3) rim 28 drops slightly below upper forwardmost rim 30 of tubular member 14 due to a slight fairing of the inner circumferences of the rims of both the tubular member 14 and the sleeve 18. The inner circumference of the upper rim of sleeve 18 is also faired to make hoisting sleeve 18 on tubular member 14 easier.

Once the sail 10 has been hoisted, and sleeve 18 has been latched onto the top of tubular rotatable member 14, halyard 22 is released from hook 22 and completely removed from connection with the sail. Halyard 22 may therefore be a spliced endless loop the bight of which can be cleated to the mast while not in use. Since the halyard 22, however, is endless, it cannot be lost up the mast. Once sleeve 18 has been latched onto tubular member 14 the only forces acting on the tubular member 14 will be the axial thrust of the weight of the sail plus any additional axial tension which may be applied to the sail by the downhaul (not shown). In addition, since the center of gravity of the combined masses of the interconnected elements in the area of the peak including the sleeve 18, the shackle 20, gromet 32, peak board 34 (shown only in dotted lines) and sail 10, is below and aft of the pivot axis of tubular member 14, centrifugal force in the peak area of the sail resulting from flapping of the sail as the boat "comes about" does not tend to dislodge rim 28 of sleeve 18 from latching engagement with rim 30 of member 14.

Lowering the sail is done by tilting sleeve 18 back to a position of alignment with member 14 and simultaneously shifting it to a more coaxial position in which rim 28 becomes free of rim 30 so that sleeve 18 can slide down member 14. The repositioning of sleeve 18 to unlatch it from member 14 is done by means of a tapered plug 36. Plug 36 may be made of durable plastic molded to the forestay 16. In shape, the plug 36 includes a substantially cylindrical upper body portion having an outside diameter slightly less than the inside diameter of sleeve 18. The lower end of plug 36 tapers gradually and terminates flush with the surface of forestay 16. Sleeve 18 is forced up around plug 36 by lifting member 14 from deck level. This can be done by any suitable means such as a handle (not shown) appropriately attached to member 14. Lifting member 14 causes sleeve 18 to slide up forestay 16 around plug 16 (see FIG. 4). At first, plug 16 causes sleeve 18 to tilt aft, and rim 28 starts to rise relative to rim 30. Eventually, as sleeve 18 is pushed further onto plug 36, the forward lower shoulder (indicated at 35 in FIG. 5) of the cylindrical body portion of plug 36 contacts the inner wall of sleeve 18, tilts sleeve 18 to a position in which it is more coaxial with stay 16, and rim 28 of sleeve 18 moves forward of rim 30 of member 14. At this point, further upward motion of member 14 causes rim 30 to enter sleeve 18, and due to the fairing of the inner circumference of sleeve 18, rim 30 pushes rim 28 forward. This relieves the pressure on point 38 and sleeve 18 freely slides down member 14. During release, at the point when sleeve 18 becomes sufficiently coaxially aligned so that member 14 starts to slide up into sleeve 18, the tension on shackle 20 is reduced and this in turn reduces the tilting force on sleeve 18, so that friction between the inner surface of sleeve 18 and plug 36 is reduced thereby further facilitating the lowering of the sail. It should be noted additionally, that should sleeve 18 for any reason tend to stick on plug 36, member 14 can be rotated to dislodge sleeve 18 from plug 36. A flange 40 on plug 36 keeps sleeve 18 from travelling upwardly beyond the end of plug 36.

A second embodiment is shown in FIGS. 6 and 7. It employs a sleeve 42 similar to sleeve 18 except that it has a pawl 44 pivoted at 46 to a plate 48 mounted on the upper forward part of sleeve 42. A spring 50 is employed to urge pawl 44 toward stay 16. With this embodiment, sleeve 42 slides up member 14 until pawl 44 snaps over the top of member 14 with pawl teeth 52 latching onto lip 30. As with the embodiment of FIGS. 1–5, this arrangement employs the basic feature of the invention whereby the sleeve is unlatched by lifting member 14. In this case, pawl 44 engages a tapered plug 54 which pivots pawl 44, and thereby moves tooth 52 out of latching engagement with lip 30, whereupon sleeve 42 readily slips down member 14. With this embodiment, the center of mass of pawl 44 is located in a position such that centrifugal force due to flapping of the sail, may tend to lift the pawl, but since the pawl is very close to the axis of the stay, this effect is minimal and spring 50 is strong enough to virtually eliminate the problem. The diameter of plug 54 is larger than the inside diameter of sleeve 42 and this keeps sleeve 42 from being hoisted above the upper end of member 14.

Another embodiment of the invention adapted for use with a mast is shown in FIG. 8. In this embodiment, a spring loaded pawl 56 (spring not shown) is mounted to pivot at 57 on a plate 58 mounted on a sleeve 60. Sleeve 60 slides up and down a cylindrical inner mast member 62 which is slotted at 64 to receive the luff of a sail 66, the peak of which is connected to sleeve 60 by shackle 68. A halyard 70, passing over sheave 72, is used to hoist sleeve 60 and the sail 66. Halyard 70 has a loop 71 which is hooked onto sleeve 60 at 61. The upper portion of inner mast 62 is cut and extended by means of an inner sleeve 74, to provide a notch 76 extending around the circumference of inner mast 62. Thus when sleeve 60 is hoisted far enough for pawl tooth 78 of pawl 56 to enter notch 76, sleeve 60 becomes latched against downward motion. Unlatching is accomplished in essentially the same way as with the embodiments of FIGS. 1–7, that is, by raising the weight bearing member, i.e. the inner mast 62. This brings the upper end of pawl 56 into contact with slanting surface 80 within the upper end of outer mast 82. This causes pawl 56 to lift pawl tooth 78 out of notch 76 allowing sleeve 60 to drop down inner mast 62. Inner mast 62 is guided and held centrally within the cavity of the mast in a cylindrical socket 84 in the top of outermast 82.

In this embodiment, the halyard 70 is in the form of an endless loop which passes around a sheave 86 inside and at the base of the mast 82. Sheave 86 is adapted to grip halyard 70 in driving engagement and the tension needed for this is maintained on halyard 70 by means of spring 88 which is located adjacent to loop 71. Sheave 86 is turned by means of an external crank (not shown) which drives pinion 90 which, in turn, engages gear 92 to which sleeve 86 is connected. In this way halyard 70 is completely housed and held under sufficient tension to ensure that it will not knock or rattle as the boat rocks or swings at anchor. It is believed that this is the first instance of a completely housed endless halyard, and it is intended to claim some broadly.

In none of the embodiments described is the mast required to support the axial thrust of the weight of the sail, the downhaul or the halyard. This represents a substantial reduction in stress. Of course, the mast and stays still must bear the lateral thrust of the sail in all three of the embodiments described, but yet any reduction in stress on the mast is valuable. In addition, in all three embodiments an essentially fool-proof, but yet simple and inexpensive latching and unlatching mechanism is provided. Further, in all three embodiments an endless halyard may be employed.

Various further modifications of the invention will now be apparent to those skilled in the art and therefore it is not my intention to confine the invention to the precise forms herein shown but rather to limit it in terms of the appended claims in which:

I claim:

1. Apparatus for supporting and furling a fore-and-aft sail comprising; a mast:

a vertically slidable and rotatable sail furling member supported at least in part by said mast;

means for slidably connecting the luff of said sail to said rotatable sail furling member;

means for supporting the weight of said sail on said rotatable sail furling member mounted for longitudinal sliding motion thereon, means for latching said slidable weight supporting means to the top of said rotatable sail furling member, and means responsive to substantially vertical upward sliding motion of said rotatable sail furling member for unlatching said slidable weight supporting means member from the top of said rotatable member.

2. The apparatus defined in claim 1 further characterized by:

said mast supporting a stay and said rotatable sail furling member mounted for substantially vertical upward sliding motion on said stay.

3. The apparatus defined in claim 1 further characterized by:

said rotatable sail furling member mounted for said substantially vertical upward sliding motion within said mast.

4. The apparatus defined in claim 1 further characterized by:

halyard means releasably connected to said sail weight supporting means for hoisting said sail on said rotatable sail furling member.

5. The apparatus defined in claim 1 further characterized by:

said sail weight supporting means comprising a sleeve.

6. The apparatus defined in claim 5 further characterized by:

said latching means comprising means for abutting said sleeve with the top of said rotatable furling member and said means for unlatching said sleeve comprising means responsive to said substantially vertical upward motion of said rotatable furling member for aligning said sleeve coaxially with said rotatable furling member in a position of non-abuttment with said upper end.

7. The apparatus defined in claim 5 further characterized by said latching means including a spring-loaded pawl on said sleeve adapted to latch onto the top of said rotatable furling member, and said means for unlatching said sleeve comprising means responsive to said substantially vertical upward motion of said rotatable furling member for releasing said pawl from said rotatable furling member.

8. Apparatus for hoisting a sail on a hollow mast comprising:

a pair of sheaves spaced vertically within said mast, a sail hoisting halyard on said sheaves forming an endless loop;

vertically slidable and rotatable means for furling said sail supported by said mast;

means for latching said sail to the top of said rotatable furling means in a hoisted position;

means for temporarily connecting said halyard to the peak of said sail for hoisting said sail to said hoisted position and for releasing said halyard from said peak once said latching means has latched said sail to the top of said rotatable furling means; and means responsive to upward motion of said rotatable furling means for releasing said latching means.

* * * * *